US010738945B2

(12) United States Patent
Tilhof

(10) Patent No.: US 10,738,945 B2
(45) Date of Patent: Aug. 11, 2020

(54) FITTING FOR LIQUID GAS CYLINDERS AND FILLING METHOD

(71) Applicant: LPG suisse AG, Wangen (CH)

(72) Inventor: Eckhard Tilhof, Altendorf (CH)

(73) Assignee: CleanTech Swiss AG, Wangen (CH)

( * ) Notice: Subject to any disclaimer, the term of this patent is extended or adjusted under 35 U.S.C. 154(b) by 194 days.

(21) Appl. No.: 15/526,569

(22) PCT Filed: Oct. 28, 2015

(86) PCT No.: PCT/EP2015/074950
§ 371 (c)(1),
(2) Date: May 12, 2017

(87) PCT Pub. No.: WO2016/074923
PCT Pub. Date: May 19, 2016

(65) Prior Publication Data

US 2017/0350559 A1 Dec. 7, 2017

(30) Foreign Application Priority Data

Nov. 12, 2014 (EP) ..... 14192891

(51) Int. Cl.
*F17C 13/04* (2006.01)
*F17C 5/02* (2006.01)
*F17C 13/12* (2006.01)

(52) U.S. Cl.
CPC ..... *F17C 13/04* (2013.01); *F17C 5/02* (2013.01); *F17C 13/12* (2013.01);
(Continued)

(58) Field of Classification Search
CPC .. F17C 5/02; F17C 13/04; F17C 13/12; F17C 2205/0329; F17C 2205/0382;
(Continued)

(56) References Cited

U.S. PATENT DOCUMENTS 1,938,036 A * 12/1933 Martin ..... F17C 13/04 220/581
2,172,310 A * 9/1939 Thomas ..... F17C 13/04 222/6

(Continued)

FOREIGN PATENT DOCUMENTS

BE 508 126 A 1/1952
BE 508126 1/1952

(Continued)

OTHER PUBLICATIONS

Chinese Office Action for corresponding Chinese Application No. 201580061232.0 dated Nov. 2, 2018.

(Continued)

*Primary Examiner* — Andrew D StClair
(74) *Attorney, Agent, or Firm* — Renner, Otto, Boisselle & Sklar, LLP

(57) ABSTRACT

It is object of the invention to reduce the technical expenditure for refilling of gas bottles. For solving the problem, a claimed fitting comprises a gas tap for gas withdrawal and an opening for refilling a liquid gas bottle. The opening for refilling a liquid gas bottle can be connected, in particular by opening a valve, in a gas-conducting manner to a hose-shaped or tubular line of the fitting, which can extent into a liquid gas bottle by at least 300 mm, preferably at least 400 mm, if the fitting is connected with such a gas bottle. Hereby, it can achieved that the line extents into the liquefied part of the gas, which especially enables a very fast emptying though pumping. Emptying is necessary when a refilled gas bottle proves to be untight. A speed advantage is thereby achieved. Basically, there is an opening at the bottom side of the fitting adjacent to the hose-shaped or tubular line. The bottom side is the side, which adjoins the liquid gas bottle or respectively is arranged entirely in the bottle or in a bottle neck when the fitting is connected to a liquid gas bottle. This (Continued)

Figure 1:
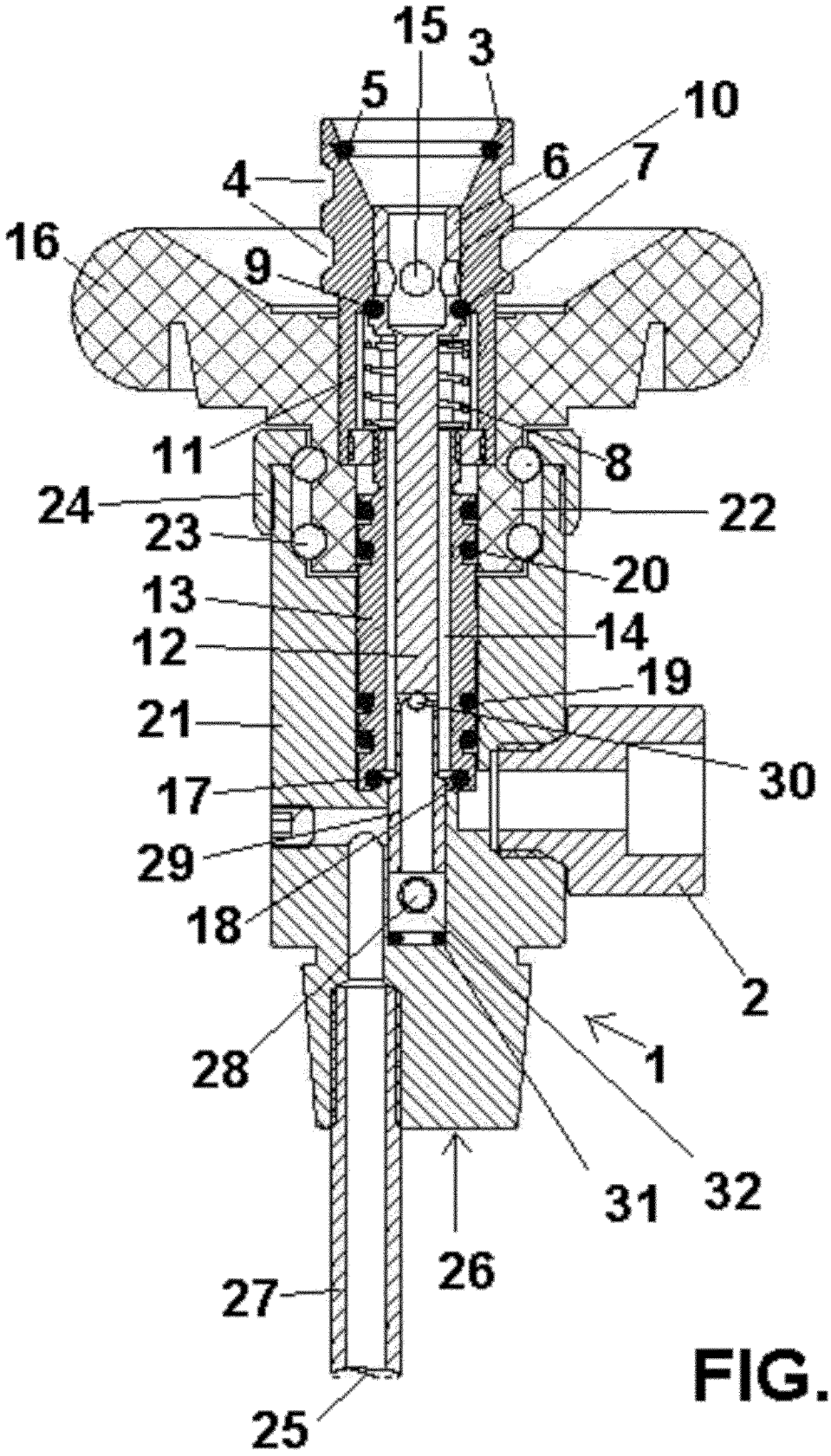

opening at the bottom side can be connected to the gas tap in a gas-conducting manner, specifically typically by rotating a corresponding rotary handle. The hose-shaped or tubular line protrudes relative to the opening, specifically in particular by at least by 200 mm, particularly preferred by at least 300 mm. A method concerns the refilling of a liquid gas bottle comprising the claimed fitting.

16 Claims, 5 Drawing Sheets

(52) U.S. Cl.
CPC .. *F17C 2201/032* (2013.01); *F17C 2201/056* (2013.01); *F17C 2201/058* (2013.01); *F17C 2203/0639* (2013.01); *F17C 2205/0329* (2013.01); *F17C 2205/0332* (2013.01); *F17C 2205/0385* (2013.01); *F17C 2205/0394* (2013.01); *F17C 2221/035* (2013.01); *F17C 2223/0153* (2013.01); *F17C 2223/047* (2013.01); *F17C 2225/047* (2013.01); *F17C 2227/04* (2013.01); *F17C 2270/0709* (2013.01)

(58) Field of Classification Search
CPC ..... F17C 2205/0385; F17C 2205/0391; F17C 2205/0394; F17C 2205/0397; F17C 2205/0323
USPC ..... 137/590–592
See application file for complete search history.

(56) References Cited

U.S. PATENT DOCUMENTS

| | | | | |
|---|---|---|---|---|
| 2,529,275 | A * | 11/1950 | Blumer | F16K 21/18 137/588 |
| 3,589,397 | A * | 6/1971 | Wagner | F16K 1/305 137/614.2 |
| 4,077,422 | A * | 3/1978 | Brinkley | F16K 17/30 137/68.14 |
| 5,033,499 | A * | 7/1991 | Patel | F16K 1/305 137/269 |
| 6,994,113 | B2 * | 2/2006 | Rousselin | F16K 1/305 137/613 |
| 7,040,359 | B2 * | 5/2006 | Younkle | B05B 1/265 141/255 |
| 2008/0011785 | A1 * | 1/2008 | Braun | B67D 7/0294 222/400.7 |
| 2011/0114208 | A1 * | 5/2011 | Newman | F17C 13/04 137/588 |
| 2013/0153084 | A1 | 6/2013 | Camilotti et al. | |
| 2014/0326328 | A1 | 11/2014 | Newman | |

FOREIGN PATENT DOCUMENTS

| | | | |
|---|---|---|---|
| CN | 2098642 | U | 3/1992 |
| DE | 04334182 | A1 | 4/1995 |
| EP | 2 169 294 | A1 | 3/2010 |
| ES | 2 423 107 | A1 | 9/2013 |
| FR | 55 136 | E | 6/1951 |
| FR | 55136 | E | 6/1951 |
| FR | 2 618 875 | A1 | 2/1989 |
| GB | 1 172 403 | A | 11/1969 |
| GB | 1172403 | | 11/1969 |
| JP | S56-99199 | U | 8/1981 |
| JP | H05-215299 | A | 8/1993 |
| JP | H08(1996)-170797 | A | 7/1996 |
| JP | H09-166293 | A | 6/1997 |
| JP | H10(1998)-061892 | A | 3/1998 |
| JP | H10-196896 | A | 7/1998 |
| JP | 2000 46297 | A | 2/2000 |
| JP | 2000 46298 | A | 2/2000 |
| JP | 2002-181299 | A | 6/2002 |
| JP | 2003-014193 | A | 1/2003 |
| JP | 2006-283899 | A | 10/2006 |
| JP | 2008-105699 | A | 5/2008 |
| JP | 2013-537606 | A | 10/2013 |
| WO | 2010/030921 | A1 | 3/2010 |
| WO | 2010/136161 | A1 | 12/2010 |
| WO | 2014/053748 | A1 | 4/2014 |
| WO | 2014/1 59516 | A1 | 10/2014 |

OTHER PUBLICATIONS

International Search Report and Written Opinion for corresponding Patent Application No. PCT/EP2015/074950 dated Feb. 29, 2016.
European Office Action for corresponding European Patent Application No. 15 797 869.3-1010 dated Sep. 24, 2018.
Japanese Office Action and English language translation for corresponding Japanese Patent Application No. 2017-525523 dated May 21, 2019.

* cited by examiner

FITTING FOR LIQUID GAS CYLINDERS AND FILLING METHOD

The invention concerns a fitting for liquid gas bottles as well as a method for refilling with liquid gas.

A gas bottle is a pressure container commonly consisting of metal, usually of steel, for the transportation and storage of gases being under pressure. Such a bottle may have a volume of more than 100 liters. The nominal pressure may amount to several hundred bars.

In liquid gas bottles, there are gases like for example LPG in liquefied state. Common gases are ethane, propane, butane as well as mixtures thereof. The gases can be liquefied at room temperature by comparatively low pressure. The liquid gas content of such bottles usually lies between 3 and 33 kg. The height of such liquid gas bottles often lies between 420 mm and 1290 mm. The bottle diameter typically lies between 200 mm and 318 mm.

Liquid gas bottles are closed with a fitting, which allows, often in conjunction with a pressure reducer, a suitable hosepipe for controlled withdrawal of its contents to be screwed on. Moreover, at liquid gas bottles, a safety valve is arranged in the withdrawal fitting, which limits the allowable overpressure in the bottle to for example ca. 30 bars in order to prevent bursting.

Typically, a fitting of such liquid gas bottle has a sideward connection nozzle as gas tap, which on the one hand is used for the filling and on the other hand for the withdrawal. At this gas tap, lines are manually screwed on to in both cases the withdrawal as well as a refilling. When the gas tap is open, the sideward connection nozzle is connected with an opening at the bottom side of the fitting in a gas-conducting manner. This bottom side of the opening is arranged above the liquid level in set up (erected) condition of the liquid gas bottle. During withdrawal of gas, it is thus withdrawn the gas, which is located above the liquid level in the gaseous phase.

Liquid gas bottles are used for the operating gas stoves, gas cookers, gas barbecues, gas heaters or gas radiant heaters. When the content of a liquid gas bottle is used up, liquid gas bottles are returned by the user to the point of sale for the purpose of renewed refilling. After such a return of a liquid gas bottle, it is transported from the point of sale to a central filling system respectively filling station.

In order to make a refilling easier, it is known from the document DE 43 34 182 A1 to provide a centric filling point in addition to a sideward connection nozzle respectively sideward gas tap. A filling may then be carried out from above without necessity of alignment of a sideward protruding gas tap.

It is object of the invention to reduce the technical expenditure for refilling of gas bottles.

The problem of the invention is solved by a fitting with the features of the main claim. Advantageous embodiments result from the dependent claims. An advantageous method for refilling comprises the features of the independent claim.

For solving the problem, a claimed fitting comprises a gas tap for gas withdrawal and an opening for refilling a liquid gas bottle. The opening for refilling a liquid gas bottle can be connected, in particular by opening a valve, in a gas-conducting manner to a hose-shaped or tubular line of the fitting, which can extent into a liquid gas bottle by at least 300 mm, preferably at least 400 mm, if the fitting is connected with such a gas bottle. Hereby, it can achieved that the line extents into the liquefied part of the gas, which especially enables a very fast emptying though pumping.

Emptying is necessary when a refilled gas bottle proves to be untight. A speed advantage is thereby achieved.

Basically, there is an opening at the bottom side of the fitting adjacent to the hose-shaped or tubular line. The bottom side is the side, which adjoins the liquid gas bottle or respectively is arranged entirely in the bottle or in a bottle neck when the fitting is connected to a liquid gas bottle. This opening at the bottom side can be connected to the gas tap in a gas-conducting manner, specifically typically by rotating a corresponding rotary handle. The hose-shaped or tubular line protrudes relative to the opening, specifically in particular by at least by 200 mm, particularly preferred by at least 300 mm.

Hereby, it can be achieved that gas above the liquid level can be withdrawn through the gas tap and thus is available immediately in the form, in which the gas is needed in the case of a consumption.

The hose-shaped or respectively tubular line is therefore preferably such long that it extents to the bottom of a gas bottle that is connected to the fitting. Typically, this line is therefore not longer than 1290 mm.

The opening for refilling the liquid gas bottle is arranged preferably at the upper side of the fitting. This makes refilling easier, because a liquid gas bottle does not have to be aligned for refilling. In particular, automatic refilling in an automated filling station is thus possible with low technical expenditure.

The gas tap, though which the gas is withdrawn for consumption, is protruding preferably sidewards from the fitting. By means of the rotary handle respectively handwheel, the gas tap can be preferably opened and closed. The handwheel is preferably arranged around the feed line for refilling. For example a nut with spindle is actuated though the handwheel, specifically in such a way that a body provided for that purpose may be moved up and down. The gas tap is thereby opened and closed.

In one embodiment, the opening for refilling a liquid gas bottle may be opened and closed by a valve. This facilitates and accelerates refilling, because a liquid pressure suffices to open the valve for refilling.

The valve comprises preferably a valve body, which is pressed to his closed valve position by a biased spring. This contributes to enable opening the valve for refilling solely by means of a liquid pressure. Furthermore, emptying though pumping is made easier, because the valve may be opened by a nozzle or a pin of a suction head by connecting the suction head with an opening provided for that. Subsequent to that, it can be immediately sucked, which enables automated refilling that can be conducted even by an end-user under consideration of the then required increased safety effort.

Preferably, the valve body is a hollow cylinder, which comprises a sideward opening. The valve may then be advantageously a part of a line, though which the liquid gas is guided into the bottle for refilling or though which liquid gas is sucked for emptying.

The valve body is preferably equipped with a circumferential, exchangeable sealing ring, which closes the valve in a liquid and gas tight manner in the closed state. In case of a leakage, the exchange of the sealing ring typically suffices to restore the full functionality of the fitting.

In one advantageous embodiment, the sealing ring is pressed in the closed state of the valve against a conical passage, which connects a tubular section with a compared with this broadened tubular section. This embodiment enables to use both tubular sections as feed line in order to thereby allow compact production with low technical expenditure.

In one embodiment, there is a closing element, in particular in the shape of a hollow cylindrical section, which, if the valve body is moved in its opened position, interrupts a gas-conducting connection between the gas tap and the opening at the bottom side of the fitting, in which the gas of a connected liquid gas bottle may flow into. In case of emptying though pumping, it is hereby achieved that liquid is pumped and not for example gas, which would delay emptying.

Preferably, the hollow cylindrical section is a section of the line, which connects the gas tap with an opening at the bottom side of the fitting, in which the gas of a connected liquid gas bottle may flow into. This reduces the technical expenditure of production and also enables a compact design.

The opening for refilling a liquid gas bottle is preferably funnel-shaped in order to make connecting to a filling head or suction head though centering easier.

Preferably, the fitting is designed such that either gas is withdrawn though the gas tap, or refilling or emptying is carried out though the opening provided for that. Simultaneous refilling and withdrawal of gas though the gas tap is not possible. This avoids risks during a gas withdrawal or during refilling.

In one embodiment of the invention, there is a further gas withdrawal means, preferably though a quick connector. For example a hose may be connected to this further withdrawal means, specifically for permanent, basically not controllable gas withdrawal. This further withdrawal means is provided for balloonists in order to allow permanent supply of a flame with gas. This flame serves for example as pilot flame. This flame basically needs only little gas. It can thereby be f. ex. prevented that excessively much of gas is consumed due to a too far turned on handwheel for the pilot flame. If a quick connector is provided, the gas withdrawal may be enabled only by connecting a corresponding couple piece. An unintentional opening is thereby avoided.

In one embodiment, there is a burst securing, which is destroyed at excessively high internal pressure in order to let gas escape in a controlled manner and thereby to reduce a too high internal pressure.

In the following, the invention is explained in detail based on figures.

Figure 2:
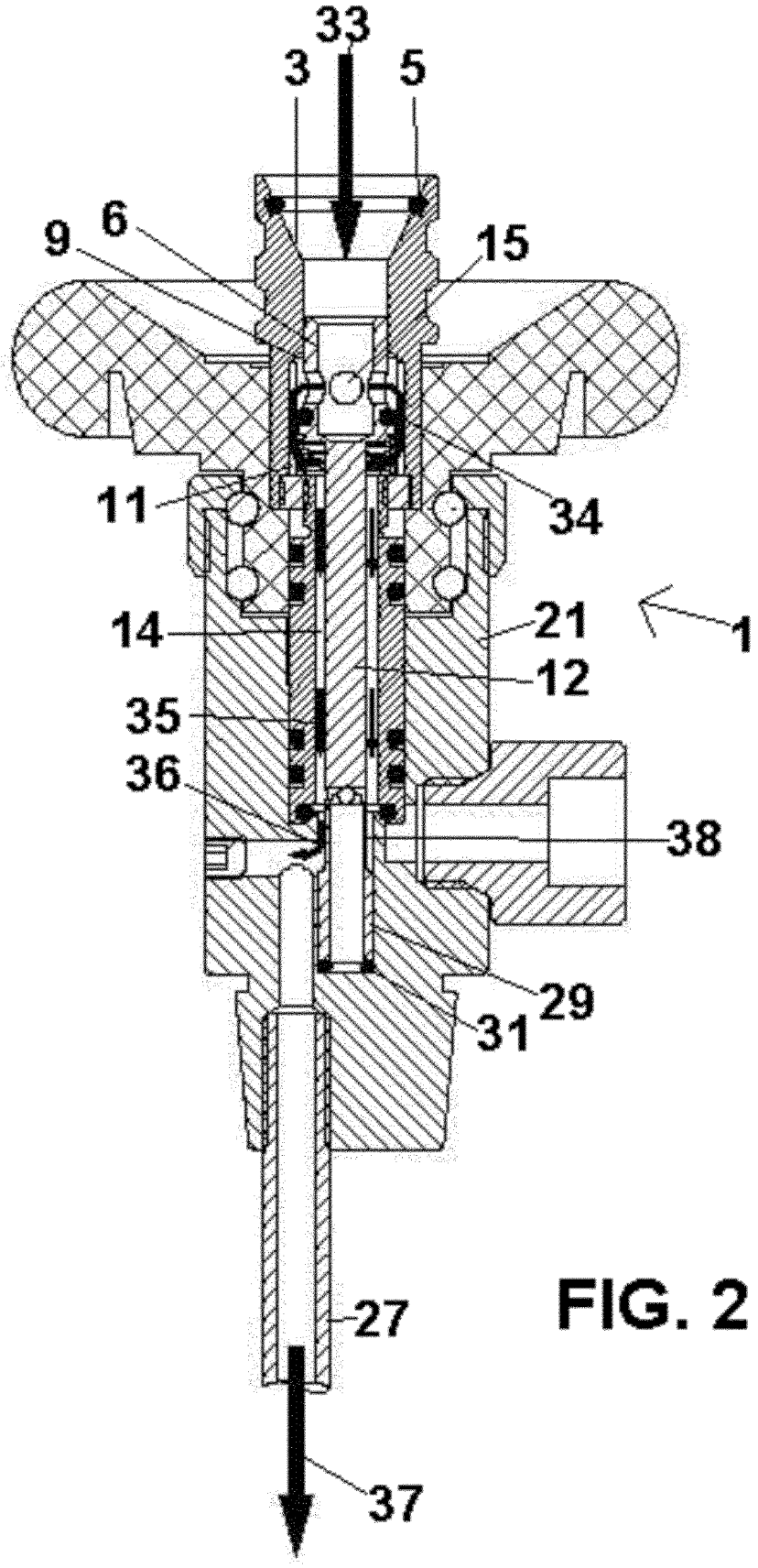
Figure 3:
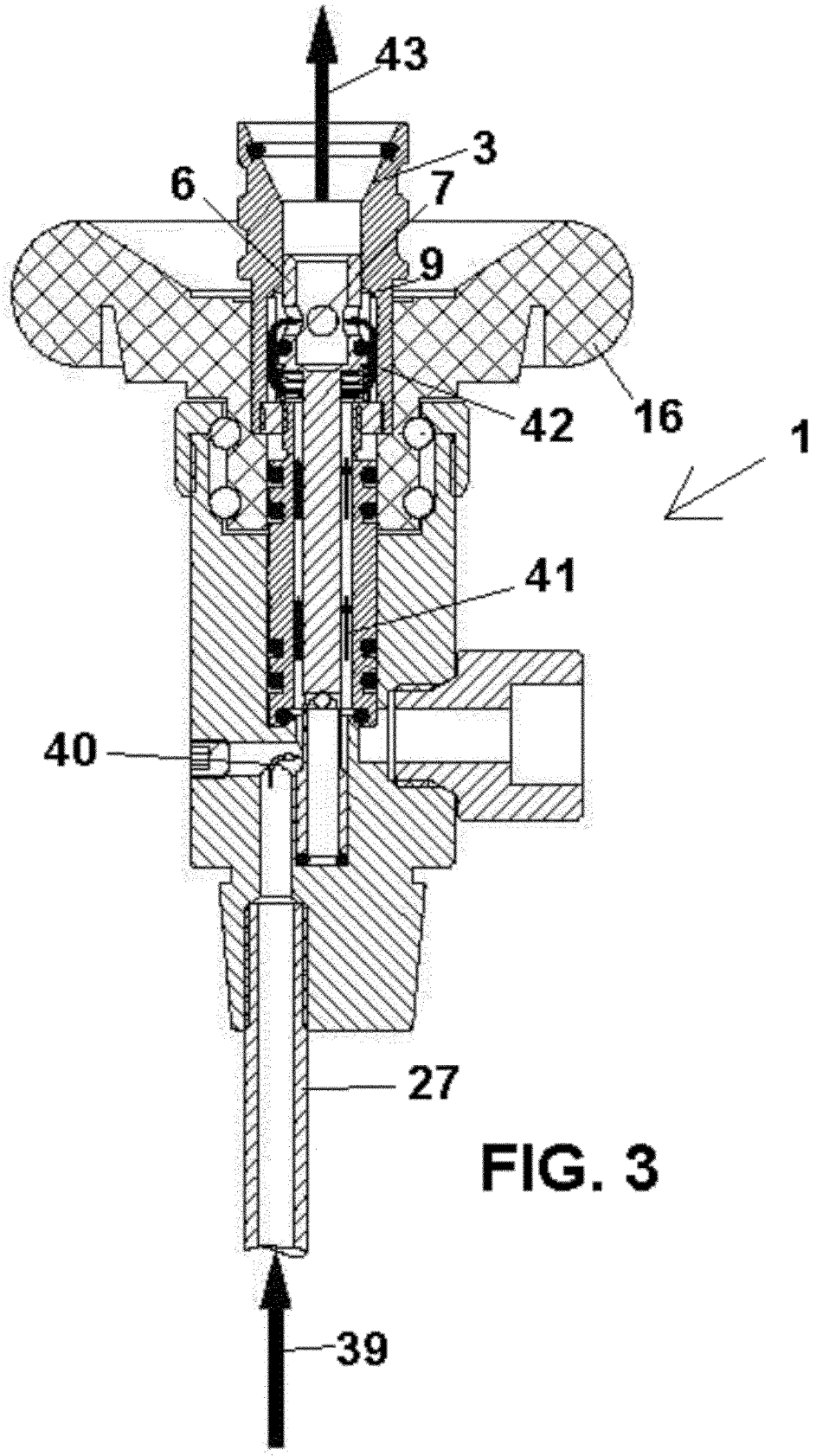
Figure 4:
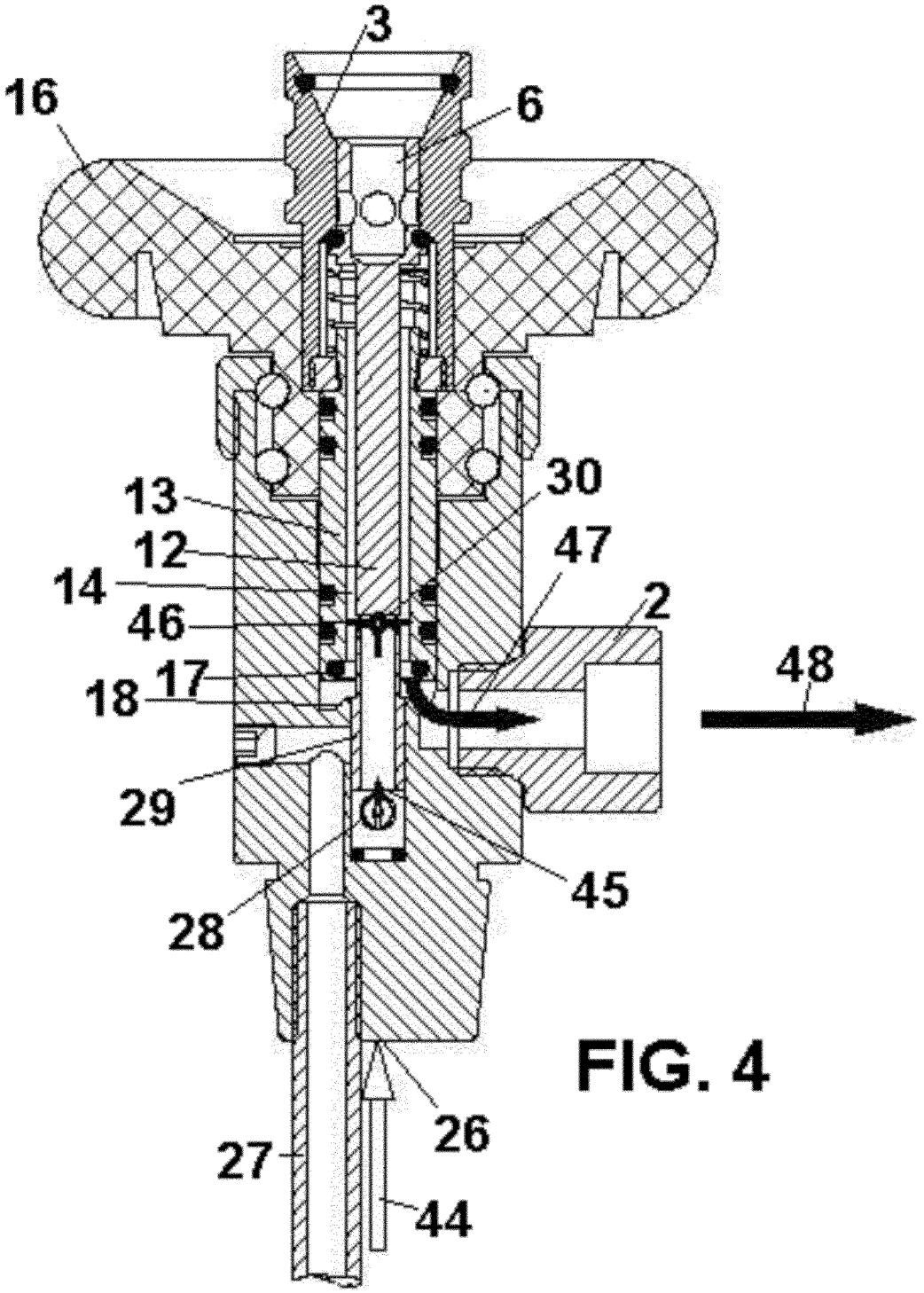
Figure 5:
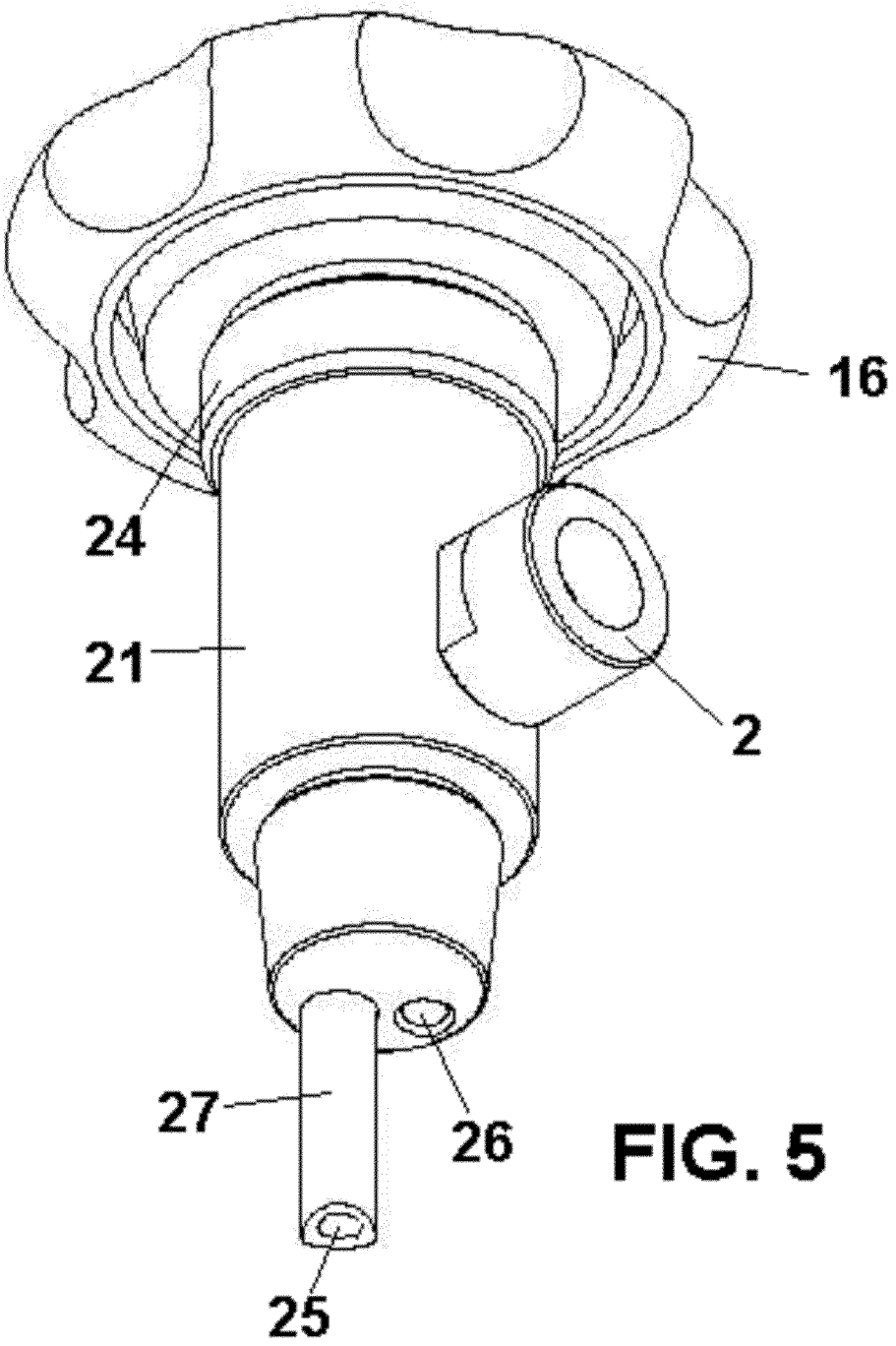

It shows:

FIG. 1: Fitting with closed gas tap and closed valve;

FIG. 2: Fitting with closed gas tap and opened valve;

FIG. 3: Fitting with closed gas tap and opened valve;

FIG. 4: Fitting with opened gas tap and closed valve;

FIG. 5: Fitting in a three dimensional illustration.

FIG. 1 shows a fitting 1 for a gas bottle in a sectional view. There is a gas tap 2 with an external thread, which protrudes sidewards, specifically horizontally from a standing not shown gas bottle when the fitting 1 is properly connected to a gas bottle. The line of a gas consumer, such as a gas barbeque, may be screwed on the gas tap 2 for withdrawing gas.

In addition to the sidewards protruding nozzle 2, there is a funnel-shaped opening 3 at the upper side into the fitting 1. The upwards leading funnel-shaped opening 3 serves as centrical filling and suction point. For filling or sucking, the funnel-shaped inlet respectively opening 3 is connected to a filling head or suction head of a gas filling station.

An upper area of the outer wall of the centrical filling point, which is accessible from outside, has two circumferential grooves 4 to enable an embracing in a positive (form-fit) manner by means of complementary formed grippers of a filling head or suction head. In this way, a positive connection (form-fit) between the outer wall having the grooves 4 and a suction head or filling head can be obtained during filling or during suction of gas, in order to avoid an unintentionally detaching of a head during the filling or emptying of a gas bottle.

In order to secure a tight connection during filling or emptying, a sealing ring 5 is hold in the funnel-shaped opening 3 by means of a circumferential notch. A filling head or suction head, respectively, is pressed against this sealing ring 5 during filling or emptying.

A hollow cylindrical valve body 6 has a sealing ring 7 in a lower area, which is hold in a corresponding circumferential notch of the valve body 6. By means of a spring 8, the valve body 6 is biased towards the opening 4. The sealing ring 7 is hereby pressed against a conical passage 9 for closing the valve. The entry though the opening 4 into the fitting 1 is then closed in a gastight and liquid-tight manner as shown in FIG. 1, specifically more reliable and permanent compared to the ball valve of the centric filling point known from the document DE 43 34 182 A1. In case of a leakage of the valve due to signs of fatigue, it is typically sufficient to exchange the sealing ring 9.

In the closed state, the valve body 6 is located, as shown in FIG. 1, mostly in a tubular section 10, whose inner diameter corresponds to the outer diameter of the valve body 6. The valve body 6 is thus guided by means of this tubular section 10.

The spring 8 is arranged in a, compared to this, broadened tubular section 10. Through the conical passage 9, the tubular section 10 is connected with a thereto compared broadened tubular section 11. The inner diameter of the broadened section 11 is slightly larger than the diameter of the spring 8. The broadened section 11 thus serves among others to holding and guiding the spring 8 when it is further biased for opening the valve.

The hollow cylindrical valve body 6 is at the lower end closed with a rod 12. The rod 12 extents into a cylinder 13. The inner diameter of the cylinder 13 is larger than the outer diameter of the rod 12 such that a free space 14 between the cylinder 13 and the rod 12 remains.

The end of the hollow cylindrical valve body 6, which is opposite to the rod 12, is open. Moreover, the valve body 6 comprises sideward openings 15 near the rod 12, which are connected to its interior space in a gas-conducting manner or respectively are leading into its interior space. The valve is opened, when the valve body 6 is pressed downwards by a liquid pressure or mechanically until the sideward openings 15 reach into the broadened section 11. The opened state of the valve is shown in FIGS. 2 and 3.

In order to open and close the sideward nozzle 2, there is a rotary handle 16, also called handwheel. Though purposeful rotating of the rotary handle or handwheel 16, respectively, the cylinder 13 can be moved between a closing position and an opening position back and forth. FIG. 1 shows the closing position of the cylinder 13. A sealing ring 17 at the lower end of the cylinder 13 is then pressed against a bevel 18 for closing. This closure is lifted (resolved) by moving the cylinder upwards through corresponding rotating of the rotary handle 16. FIG. 4 shows the open position of the cylinder 13.

The cylinder 13 is sealed by sealing ring 19 against a section 21 of the housing wall of the fitting 1. Moreover, cylinder 13 is sealed by sealing ring 20 against a cylindrical lower section 22 of the rotary handle 16. The sealing rings 19 and 20 prevent escape of gas out of the fitting.

The rotary handle 16 is hold by a ball bearing 23. A flap 24 is screwed on the housing section 21 in order to thereby connect the rotary handle 16 to the housing section 21.

The fitting 1 has at the bottom side two openings 25 and 26 (see in particular also the three dimensional illustration of FIG. 5). This bottom side is located in the gas bottle respectively in the bottle neck, when the fitting is connected with a gas bottle.

The opening 25 is located at a lower end of a hose-shaped or respectively tubular line 27 at the bottom of a correspondingly connected gas bottle. Through this opening 25, subsequent to opening the valve with the valve body 6, the gas bottle is filled with gas or liquid gas is sucked. Though the other opening 26, withdrawal of gas from the bottle is carried out for consumption by a user being connected to the gas tap 2, specifically subsequent to opening the gas tap by rotating the rotary wheel 16.

The opening 26 is connected to an interior opening 28 in a gas-conducting manner.

At the lower end of the rod 12, a therewith connected hollow cylindrical section 29 adjoins, which has an opening 30 in the passage between rod 12 and section 29. When the valve body 6 is pressed downwards, the hollow cylindrical section 29 is pressed against a leasing ring 31, which is located at the lower end of a guide 32.

FIG. 1 shows the case that the fitting 1 is closed. Sucking or filling is not possible, because the valve is closed. Gas withdrawal though the gas tap 2 is not possible, because this is prevented by the sealing ring 17 pressing against the bevel 18, which thus closes the gas tap.

FIG. 2 illustrates the filling though the fitting 1. The sideward nozzle 2 is closed and the funnel-shaped opening 4 is connected to a not shown filling head, which is pressed against the sealing ring 5 in the funnel-shaped opening 3 in a liquid-tight manner. The opening 28, which is shown in FIG. 1, is hereby closed. A gas-conducting connection between gas tap and the opening 26 at the bottom side is thus interrupted. Liquid gas is now pumped according to the arrow 33 into the funnel-shaped opening 3. The valve body 6 is thereby pressed downwards, until the hollow cylindrical section 29 is pressed against the sealing ring 31. The sideward openings 15 of the valve body 6 are now located in the broadened tubular section 11. The liquid gas being pumped into along the arrow 33 may now flow out of the openings 15 of the valve body 6, specifically into the broadened tubular section 11. Within the broadened tubular section 11, the liquid gas may flow around the lower section of the valve body 6 as illustrated by arrows 34. The liquid gas flows from the broadened tubular section 11 into the intermediate space 14 between rod 12 and housing section 21 and thereby gets, illustrated by the arrows 35 and 36, into the tubular or hose-shaped line 27. At the lower end of the tubular or hose-shaped line 27, the liquid gas flows out of the fitting 1 according to arrow 37 and thereby gets to the bottom of a not shown gas bottle, on which the fitting 1 is mounted.

FIG. 2 illustrates that the hollow cylindrical section 29 has a smaller outer diameter 38 in an upper area to create such a distance to the adjacent housing wall, in the case of FIG. 2, that a gas flow according to arrow 36 is possible.

For sucking or emptying, the valve body 6 is pressed downwards by a pin or nozzle of a suction head being put on the funnel 3. Subsequent to that, liquid gas may be sucked, specifically according to the arrows 39 to 43, as shown in FIG. 3. Because it is sucked from the bottom due to the hose or tube 27, respectively, it is made sure that liquefied gas is withdrawn and not gaseous atmosphere above the liquid level in the gas bottle. A liquid gas bottle can therefore be pumped empty particularly fast and with low expenditure.

FIG. 4 shows the fitting 1 in the opened state of the gas tap 2 and in the closed state of the valve. The gas tap 2 is opened, because the valve body 6 is located in its closed position and the cylinder 13 was moved upwards though rotating the unit 16 and thus the sealing ring 17 was removed from the bevel 18. The gas, which is located above the liquid level in the liquid gas bottle, may now enter according to the arrow 44 into the opening 26 and flow to the interior opening 28. From the opening 28, the gas gets according to the arrow 45 into the interior space of the hollow cylindrical section 29. The gas then flows out through the opening 30 at the upper end of the hollow cylindrical section 29 and gets according to the arrow illustration 46 into the intermediate space 14. As there is now a distance between the sealing ring 17 and the bevel 18, the gas may flow according to arrow illustration 47 further into the nozzle of the gas tap 2 and from here according to arrow 48 forwarded to the consumer.

By means of such a fitting, in one corresponding embodiment, it is in particular advantageously achieved that either gas can be withdrawn though the gas tap or a refilling or emptying can be carried out though the centrical opening 3. Then, it cannot be refilled and gas withdrawn though the gas tap at the same time.

The method for refilling also includes emptying for the case that gas leakage is proven. Especially emptying may allow to be carried out particularly fast as liquid is pumped and not gas.

The invention claimed is:

1. A fitting for a liquid gas bottle, comprising:

a gas tap for gas withdrawal;

a rotary handle for opening and closing the gas tap;

a hose-shaped or tubular line, which can extend into a liquid gas bottle by at least 300 mm;

an opening for refilling a liquid gas bottle, wherein the opening for refilling a liquid gas bottle can be connected in a gas-conducting manner to the hose-shaped or tubular line of the fitting by a first fluid passageway of the fitting, wherein the opening for refilling a liquid gas bottle is arranged at the upper side of the fitting;

an opening at the bottom side of the fitting adjacent to the hose-shaped or tubular line, wherein the opening at the bottom side can be gas connected to the gas tap in a gas-conducting manner by a second fluid passageway of the fitting, and wherein the hose-shaped or tubular line protrudes relative to the opening at the bottom side;

wherein in a first state of the fitting the opening at the upper side and the hose-shaped or tubular line are not connected in a gas-conducting manner by the first fluid passageway, and the opening at the bottom side and the gas tap are not connected in a gas-conducting manner by the second fluid passageway;

wherein in a second state of the fitting the opening at the upper side and the hose-shaped or tubular line are connected in a gas-conducting manner by the first fluid passageway, and the opening at the bottom side and the gas tap are not connected in a gas-conducting manner by the second fluid passageway; and wherein in a third state of the fitting the opening at the upper side and the hose-shaped or tubular line are not connected in a gas-conducting manner by the first fluid passageway, the opening at the bottom side and the gas tap are connected in a gas-conducting manner by the second fluid passageway and the hose-shaped or tubular line is fluidly separate, within the fitting, from the second fluid passageway; and wherein the opening at the upper side protrudes upwardly through the rotary handle, and a valve is disposed in the opening at the upper side for opening and closing the first fluid passageway, the valve being operable independent of the rotary handle.

2. The fitting according to claim 1, wherein the gas tap protrudes sideways from the fitting.

3. The fitting according to claim 1, wherein the rotary handle is a handwheel.

4. The fitting according to claim 1, wherein the valve comprises a valve body, which is pressed to its closed valve position by a biased spring.

5. The fitting according to claim 4, wherein the valve body is a hollow cylinder, which comprises sideward openings.

6. The fitting according to claim 4, wherein the valve body is provided with a circumferential, exchangeable sealing ring, which closes the valve in a liquid and gas tight manner in the closed state.

7. The fitting according to claim 6, wherein the sealing ring is pressed in the closed state against a conical passage, which connects a tubular section with a broadened tubular section that is relatively broader than the tubular section.

8. The fitting according to claim 4, wherein there is a closing element, in particular in the shape of a hollow cylindrical section, which, if the valve body is moved in its opened position, interrupts a gas-conducting connection between the gas tap and the opening at the bottom side of the fitting, in which the gas of a connected liquid gas bottle may flow into.

9. The fitting according to claim 8, wherein the hollow cylindrical section is a section of the line, which connects the gas tap with an opening at the bottom side of the fitting, in which the gas of a connected liquid gas bottle may flow into.

10. The fitting according to claim 1, wherein the gas tap is mandatorily closed when a valve for refilling is opened, and/or vice versa the valve for refilling is mandatorily closed when the gas tap is opened.

11. The fitting according to claim 1, wherein there is a further opening having a quick connector, through which the gas can be withdrawn.

12. A method for refilling a liquid gas bottle, the method comprising:

providing a liquid gas bottle including the fitting of claim 1, connecting a filling head of a filling station to the opening of the fitting, subsequently filling the gas bottle with liquid gas, subsequent to the filling, testing for leakage of gas from the gas bottle, if the test reveals that no gas escapes from the gas bottle, allowing removal of the refilled gas bottle from the filling station, if the test reveals that gas does escape from the gas bottle, emptying the gas bottle by sucking liquid gas through the opening which is provided for refilling.

13. The fitting according to claim 1, wherein the hose-shaped or tubular line of the fitting can extend into a liquid gas bottle by at least 400 mm.

14. The fitting according to claim 1, wherein the hose-shaped or tubular line protrudes relative to the opening at the bottom side by at least 300 mm.

15. The fitting according to claim 1, wherein the opening at the bottom side of the fitting is a first opening at the bottom side, wherein the fitting comprises a second opening at the bottom side, wherein the first opening at the bottom side is offset from and adjacent to the second opening at the bottom side, wherein the hose-shaped or tubular line is partially disposed within the second opening at the bottom side, and wherein the hose-shaped or tubular line protrudes relative to the first opening at the bottom side and the second opening at the bottom side.

16. The fitting according to claim 1, further comprising:

a housing;

wherein the opening at the bottom side is a first opening at the bottom side of the fitting, wherein a bottommost surface of the housing includes the first opening at the bottom side and a second opening at the bottom side, and wherein the hose-shaped or tubular line extends from within the second opening at the bottom side through the bottommost surface and is offset from the first opening at the bottom side.

* * * * *